United States Patent [19]

Hardin et al.

[11] Patent Number: 5,070,614

[45] Date of Patent: Dec. 10, 1991

[54] ROTARY POSITIONABLE RAZOR HEAD ARRANGEMENT

[76] Inventors: Terrill R. Hardin, 202 Parcel Ave., Yacolt, Wash. 98675; Andrew C. Tobel, 3513 "R" St., Vancouver, Wash. 98663

[21] Appl. No.: 592,088

[22] Filed: Oct. 3, 1990

[51] Int. Cl.[5] ..... B26B 21/06

[52] U.S. Cl. ..... 30/87; 30/89

[58] Field of Search ..... 30/87, 89, 57, 47

[56] References Cited

U.S. PATENT DOCUMENTS

| | | | |
|---|---|---|---|
| 991,998 | 5/1911 | Jones | 30/89 |
| 4,083,103 | 4/1978 | Estandian | 30/47 |
| 4,163,316 | 8/1979 | Hagmann et al. | 30/47 |
| 4,514,904 | 5/1985 | Bond | 30/87 |
| 4,617,736 | 10/1986 | McCrary | 30/47 |
| 4,739,553 | 4/1988 | Lazarchik | 30/169 |

*Primary Examiner*—Mark Rosenbaum
*Assistant Examiner*—John M. Husar
*Attorney, Agent, or Firm*—Henderson & Sturm

[57] ABSTRACT

A rotary positionable razor head arrangement (10) which includes a head unit (11) rotatably and captively connected to a two-piece handle unit (12). The handle unit (12) is provided with a splined circular recess (26) and an enlarged smooth recess (27) which are dimensioned to receive a splined stub member (16) having a radial flange portion (18) such that, the head unit (11) may be rotatably oriented in a single plane relative to the handle unit (12).

1 Claim, 1 Drawing Sheet

FIG. 1.
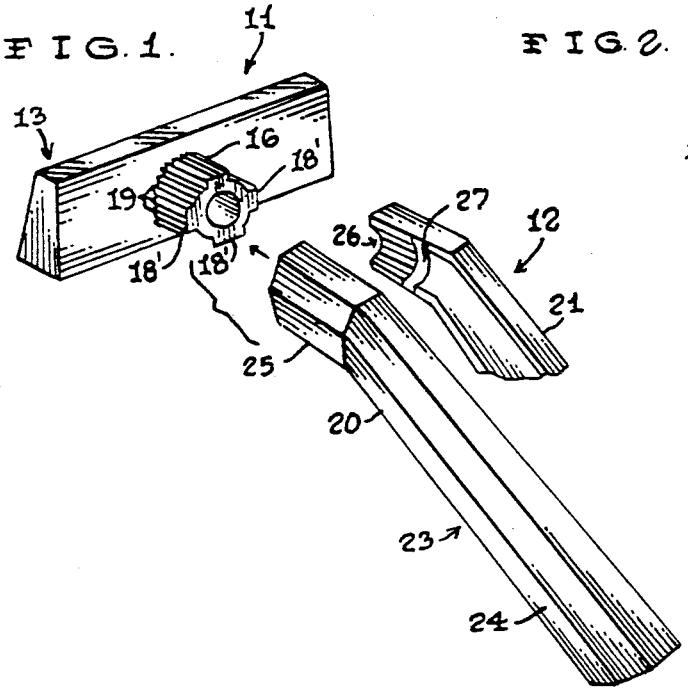
FIG. 2.
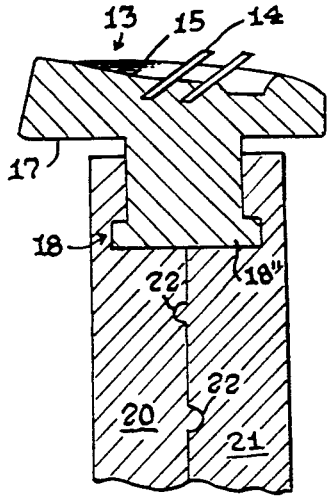
FIG. 3.
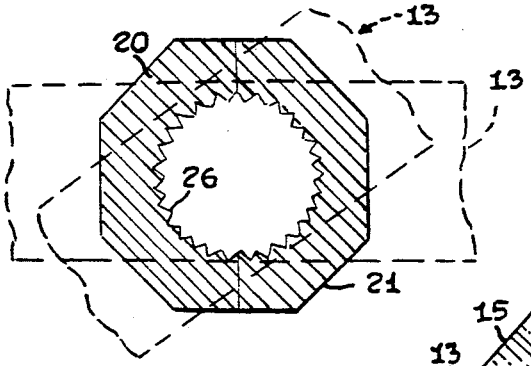
FIG. 5.
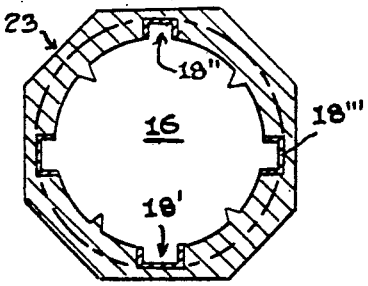
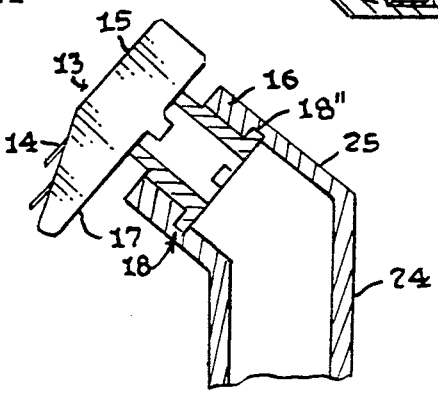
FIG. 4.

ROTARY POSITIONABLE RAZOR HEAD ARRANGEMENT

TECHNICAL FIELD

The present invention relates to the field of adjustable head razor blade arrangements in general, and in particular to a selectively positionable razor head that may be rotatably engaged with the handle of the razor blade at a wide variety of angular orientations within a single plane.

BACKGROUND ART

As can be seen by reference to the following U.S. Pat. Nos. 4,163,316; 4,514,904; 4,617,736; and 4,739,553; the prior art is replete with myriad and diverse adjustable razor blade constructions wherein the term razor blade encompasses both the shaver head and the shaver handle.

While all of the aforementioned prior art constructions are more than adequate for the basic purpose and function for which they have been specifically designed, these patented constructions are uniformly deficient with respect to the fact that they are over-engineered and structurally complex.

Obviously, any structural arrangement that employs a large number of parts is going to be very expensive to manufacture and will be particularly susceptible to breakage of one of the parts which normally will result in the device being rendered inoperative by a relatively insignificant part.

As a consequence of the foregoing situation, there has existed a longstanding need for a simple and effective way to provide an adjustable razor head arrangement that will employ as few parts as possible while still allowing for a virtually 360° rotation between the razor head and the razor handle, and the provision of such a construction is a stated objective of the present invention.

DISCLOSURE OF THE INVENTION

Briefly stated, the arrangement that forms the basis of the present invention comprises a razor head unit and a two piece razor handle unit which captively engages the razor head unit.

In addition, both the razor head unit and the razor handle unit are provided with splined portions which releasably engage one another to permit selective and incremental rotation of the razor head unit relative to the razor handle in a single plane.

As will be explained in greater detail further on in the specification, the razor handle unit is further provided with an internal peripheral groove which is dimensioned to captively and rotatably receive at least one outwardly projecting radial flange element which is formed on the razor head unit such that the razor head unit will be captively, yet movably, engaged with respect to the handle unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an exploded perspective view of the arrangement that forms the basis of the present invention;

FIG. 2 is a side cross sectional view showing the snap fit engagement between the head and handle units;

FIG. 3 is a cross-sectional view taken through line 3—3 of FIG. 2;

FIG. 4 is a cross sectional view showing a variation of the handle unit; and FIG. 5 is a cross sectional view taken through line 5—5 of FIG. 4.

BEST MODE FOR CARRYING OUT THE INVENTION

As can be seen by reference to the drawings, and in particular to FIG. 1, the rotary razor head arrangement that forms the basis of the present invention is designated generally by the reference numeral (10). The arrangement (10) comprises in general, a razor head unit (11) and a two piece razor handle unit (12). These units will now be described in seriatim fashion.

As shown in FIGS. 1, 2, and 4, the razor head unit (11) comprises a generally rectangular contoured head member (13) provided with at least one razor blade element (14) which projects outwardly from the upper surface designated generally as (15) of the head member (13).

In addition, the head unit (11) further comprises a splined stub member (16) which is centrally disposed and depends downwardly from the bottom surface (17) of the head member (13). The splined stub member (16) is further provided with an outwardly projecting radial flange portion (18) whose purpose and function will be described in greater detail further on in the specification.

Furthermore, as can best be seen by reference to FIG. 1, the splined stub member (16) is provided with a plurality of elongated peripheral splines or teeth (19). In the preferred embodiment of the invention, the teeth (19) on the stub member (16) are generally rigid, yet deformable, for reasons that will be explained presently.

Turning now to FIGS. 1 through 3, it can be seen that the two piece handle unit (12) comprises two mirror image half handle elements (20, 21) which when joined together, such as by a complimentary snap fit relationship, designated generally by (22), combine to form an elongated handle member (23) having an elongated shaft portion (24) and a neck portion (25).

As can best be seen by reference to FIG. 1, the neck portion (25) of both handle elements (20, 21) are provided with both a reduced radius semi-circular splined recess (26) and an enlarged radius generally smooth recess (27). The splined recesses (26) are dimensioned to surround and deformably engage the teeth (19) on the splined stub member (16). The enlarged recesses (27) form a continuous enlarged internal peripheral recess in the handle member (23) which is dimensioned to captively, yet movably, engage the radial flange portion (18) on the stub member (16) such that the head member (13) is rotatably, yet captively, engaged in the neck portion (25) of the handle member (23).

In one form of the preferred embodiment depicted in FIGS. 1, 4 and 5, the radial flange portion (18) comprises a plurality of radial flange segments (18') which are arrayed around the base of the stub member (16) in a generally cross like configuration. Furthermore the handle number (23) is provided with a plurality of complimentary tapered recesses (18''') which are likewise arranged around the periphery of the splined recess (26) in a cross-like configuration; wherein, the flange segments (18') are intended to be resiliently deformed by the tapered recesses (18''') such that the flange segments (18') are received in the recess (27) in a snap fit relationship.

In another version of the preferred embodiment depicted in FIGS. 2 and 3, the radial flange portion (18) comprises a continuous flanged collar (18''). However, for the purposes of this invention, it is to be understood that all that is necessary to practice the teachings of this invention is for the stub member (16) to have a radial flange portion (18) which defines a radial arc of sufficient length to hold the head member (13) captively, yet rotatably engaged relative to the handle member (23).

It should also be appreciated that given the fact that the head member (13) will have to be replaced at periodic intervals when the razor blade elements become dull. The teeth (19) on the stub member (16) are softer than the splined recesses (26) such that the stub splines (19) are deformed by the splined recesses (26) as the head member (13) is forcibly rotated to a new angular orientation relative to the handle member (23). The splines (19) will once again become meshed with the splined recesses (26) in the new angular orientation to resist relative rotation during the act of shaving.

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

We claim:

1. A rotary positionable razor head arrangement consisting of:

a head unit including a head member having an upper surface equipped with at least one razor blade element and further including a bottom surface having a downwardly depending splined stub member, centrally disposed relative to the bottom of said head member and further provided with a plurality of splined teeth and an outwardly projecting radial flange portion formed proximate the lower end of said splined stub member; and, a handle unit including two mirror image handle elements which are joined together in a snap fit fashion; and, which define on their interior surfaces: a generally circular splined recess which will deformably engage the splined teeth on the stub member; and, a generally smooth enlarged circular recess which is dimensioned to captively engage the said flange portion on the stub member.

* * * * *